US006748091B2

(12) United States Patent
Hohjyo et al.

(10) Patent No.: US 6,748,091 B2
(45) Date of Patent: Jun. 8, 2004

(54) CAPACITOR MICROPHONE AND PORTABLE TELEPHONE USING THE CAPACITOR MICROPHONE

(75) Inventors: Masayoshi Hohjyo, Kawasaki (JP); Yukihiro Oba, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/279,433

(22) Filed: Oct. 24, 2002

(65) Prior Publication Data

US 2003/0081801 A1 May 1, 2003

(30) Foreign Application Priority Data

Oct. 31, 2001 (JP) ..... P 2001-334371

(51) Int. Cl.[7] ..... H04R 25/00
(52) U.S. Cl. ..... 381/174; 381/369
(58) Field of Search ..... 381/174, 178, 381/369, 355; 361/278, 281, 299.5

(56) References Cited

U.S. PATENT DOCUMENTS 5,778,079 A * 7/1998 Wun

FOREIGN PATENT DOCUMENTS

| | | | |
|---|---|---|---|
| JP | 2001-102116 | * | 4/2001 |
| JP | 2002-044148 | | 2/2002 |
| JP | 2002-152892 | * | 5/2002 |

* cited by examiner

*Primary Examiner*—Suhan Ni
(74) *Attorney, Agent, or Firm*—Pearne & Gordon LLP

(57) ABSTRACT

To provide a capacitor microphone without molds or dies formed with a high accuracy for the manufacturing of spring terminals of the capacitor microphone, this invention provides a capacitor microphone including spring terminals attached to an insulator so as to make the spring terminals contact and conductive with contact points provided at the inside and the outside of a capacitor microphone main body. The spring terminals are provided with leg portions each formed by a pair of wire rods having elasticity which protrude in directions separating to each other toward the outside. The spring terminals can be manufactured in a short time and at a low cost and realize a stable electrical connection.

10 Claims, 6 Drawing Sheets

CAPACITOR MICROPHONE AND PORTABLE TELEPHONE USING THE CAPACITOR MICROPHONE

BACKGROUND OF THE INVENTION

1. Field of the Invention

The present invention relates to a capacitor microphone contained within a portable telephone etc. and, in particular, relates to a capacitor microphone capable of being easily coupled to a print board or a connector etc. and a portable telephone using such a capacitor microphone.

2. Description of the Related Art

Various kinds of capacitor microphones each capable of being miniaturized easily have been utilized as speech microphones for portable telephones. As the capacitor microphones, there are known ones each of which is provided with spring terminals so as to be electrically coupled to an external portion.

That is, as shown in FIGS. 11 and 12, for example, such a capacitor microphone is provided with a capacitor microphone main body 101, a casing 102 which is formed by elastic member and covers the capacitor microphone main body 101, an insulator 103 formed by composite resin etc., and a pair of spring terminals 104, 104 each of which is formed by subjecting a leaf spring member to a punching process and a bending process so as to have protruding portions 104A and 104B protruding inward and outward, respectively.

These spring terminals 104, 104 of the capacitor microphone are assembled integrally with the insulator 103. The protruding portions 104A, 104A protruding inward toward the capacitor microphone main body 101 are made in contact with pressure, at the tip end portions thereof, and electrically coupled with terminals 105A on a board 105 provided at the capacitor microphone main body 101. The other protruding portions 104B, 104B protruding outward from the spring terminals 104, 104 are made in contact with pressure and electrically coupled with the terminals 106A of a print board 106 provided on an external portion side.

Accordingly, the capacitor microphone is coupled with a not-shown microphone output signal circuit mounted on the print board 106 through the protruding portions 104A, 104B and so an audio signal can be electrically taken out.

However, each of the spring terminals of such a capacitor microphone is usually formed by subjecting a thin leaf spring member to the combination of the punching process and the bending process, so that there is such an inconvenience that it is difficult to secure an accuracy of the size of the spring terminal. As a result, the spring terminal becomes unstable in a press-contact state at its electrical contact portion with the terminal of the print board side, so that an electrically sure coupling state may not be obtained.

Although the spring terminals are assembled integrally with the insulator 103, the posture of the spring terminal at the time of assembling differs slightly at every the spring terminal. Thus, the press-contact state of the spring terminal with the terminal 105A on the board 105 provided at the capacitor microphone main body 101 also differs slightly at every the spring terminal, which results in one of causes of an unstable electrical coupling state.

Further, as described above, the spring terminal is formed by subjecting the thin plate to the punching process and the bending process. In this respect, the punching process and the bending process require molds or dies. In particular, in order to perform the punching process and the bending process with a high accuracy, the molds or dies formed with a high accuracy are also required according to the required accuracy of the punching process and the bending process. As a result, manufacturing costs of the molds or dies increase according to the required accuracy thereof and further it requires a long term to prepare such molds or dies with high-accuracy.

SUMMARY OF THE INVENTION

Accordingly, the present invention has been made in view of the aforesaid circumstances of the conventional technique and an object of the invention is to provide a capacitor microphone which does not require molds or dies formed with a high accuracy for the manufacturing of the spring terminals, and so the spring terminals can be manufactured in a short time at a low cost and stable electrical connection can be realized at a cost as low as possible, and to provide a portable telephone using the capacitor microphone.

The invention is arranged in a manner that in a capacitor microphone provided with an insulator fixed to a capacitor microphone main body and a spring terminal having leg portions attached to the insulator so as to conduct an output signal from the capacitor microphone main body to contact points of boards to which the spring terminal is to be coupled, the capacitor microphone is characterized in that the spring terminal is formed by a pair of wire rods having elasticity which protrude in directions separating to each other toward outside.

Preferably, the insulator is provided with guide grooves for housing therein tip portions of the leg portions of the spring terminal in a slidable state, respectively.

Preferably, the spring terminal has a base portion for fixing the leg portions in a state that the leg portions protrude in opposite directions from the base portion toward outside, and the base portion is almost complete round or angular shape.

Preferably, each of the leg portions of the spring terminal may be formed in a handle-shape extending integrally from the base portion and the tip end portions of the leg portions may abut against bottom surfaces of the guide grooves of the insulator.

Preferably, intermediate portions of the leg portions are made conductive with the contact points while the tip end portions of the leg portions abut against the bottom surfaces of the guide grooves of the insulator.

A portable telephone according to the invention is characterized by including the capacitor microphone according to one of claims 1 to 5, and a board coupled to the capacitor microphone.

Figure 1:
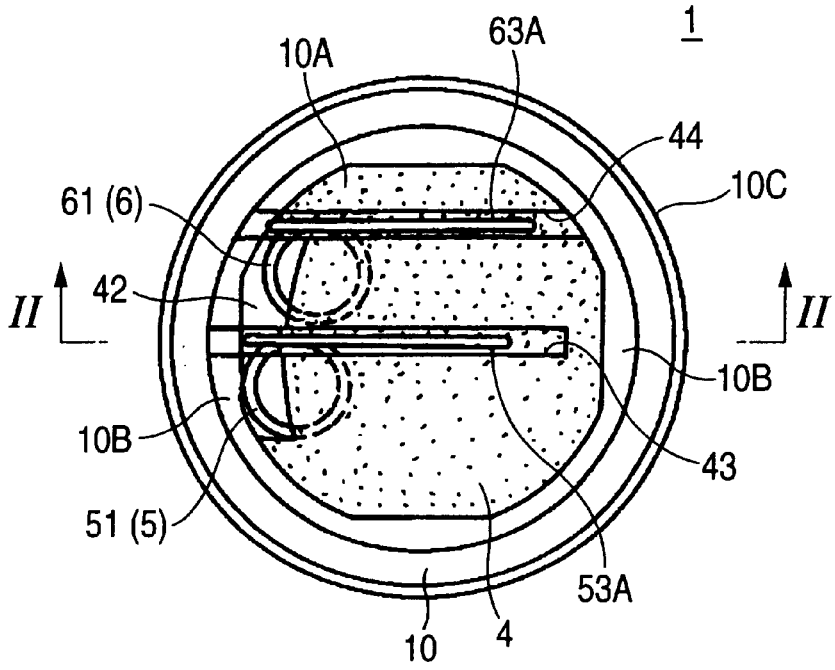
FIG. 1 is a plan view showing a capacitor microphone according to the invention.

In the drawings, a reference numeral 1 refers to a capacitor microphone; 10 to a microphone casing; 10A to an opening portion; 10B to an engagement portion; 10C to a protruding portion; 2 to a microphone main body; 2A to a concave portion; 3 to a board for microphone; 31 to a contact point (inner portion side contact point); 31A to a conductive portion; 31C to an insulation portion; 4 to an insulator; 41 to a step portion; 42 to a notched portion; 43 to a guide groove; 44 to a guide groove; 45 to an insertion hole; 46 to an insertion hole; 5 to a spring terminal; 51 to a base portion; 52 to a leg portion; 52A to an intermediate portion; 53 to a leg portion; 53A to an intermediate portion; 6 to a spring terminal; 61 to a base portion; 62 to a leg portion; 62A to an intermediate portion; 63 to a leg portion; 63A to an intermediate portion; 7 to a casing of portable telephone; 7A to an inner peripheral groove; 8 to a board; and 81 to a contact point (outer portion side contact point).

DETAILED DESCRIPTION OF THE PREFERRED EMBODIMENTS

Hereinafter, the embodiment of the invention will be explained with reference to the accompanying drawings.

Figure 2:
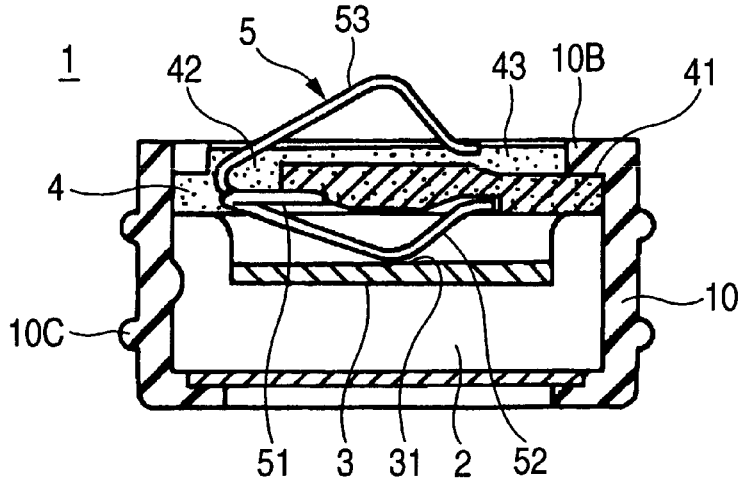
FIG. 2 is a sectional diagram along a line II—II in FIG. 1.
Figure 3:
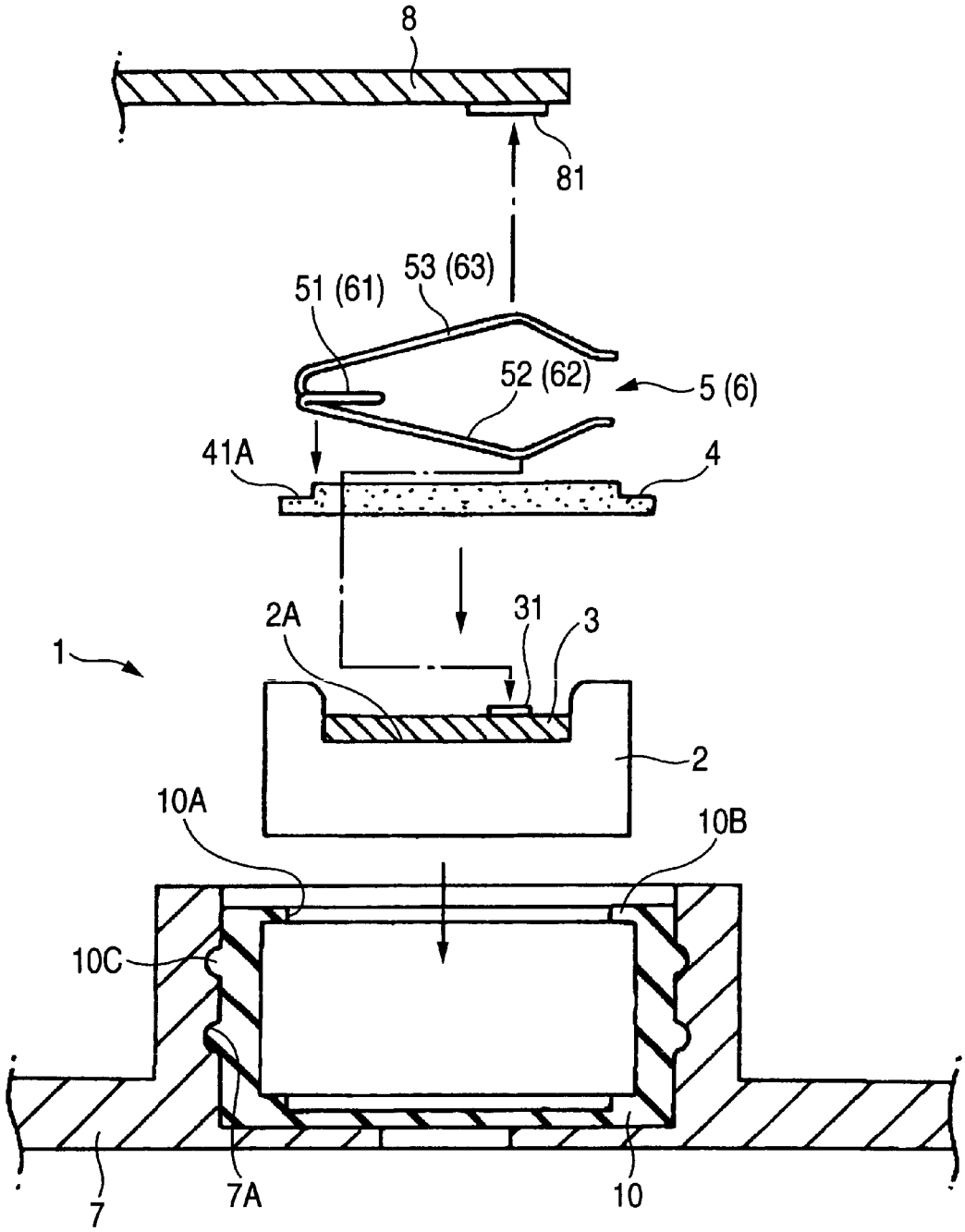
FIG. 3 is an exploded perspective view of the capacitor microphone according to the invention.

FIGS. 1 to 3 show a capacitor microphone according to the invention. A capacitor microphone 1 is attached to a not-shown portable telephone and provided with a capacitor microphone main body 2, a board 3 for a microphone, an insulator 4 and spring terminals 5, 6 within a microphone casing 10.

The microphone casing 10 is configured in an almost box shape with a hollow which is largely opened at its one side and is pushed into a microphone housing portion provided at the casing 7 (see FIG. 3) of the portable telephone and then inserted and fixed to the housing portion. The microphone casing 10 according to the embodiment is formed by material having elasticity such as rubber and houses therein the capacitor microphone main body 2 and the insulator 4 in such a state that they are wrapped by the casing from the outside.

To this end, the microphone casing 10 is provided, at the one side surface thereof where an opening portion 10A is provided, with an engagement portion 10B for preventing housed parts such as the capacitor microphone main body 2, the insulator 4 etc. from coming out of the casing. Protruding portions 10C are formed on the outer peripheral surface of the microphone casing 10 so that the protruding portions fit into inner peripheral grooves 7A of a housing portion provided at the casing 7 of the portable telephone.

The capacitor microphone main body 2 is arranged in a manner that the board 3 for the microphone (hereinafter called a microphone board) is attached to a concave portion 2A provided on the one side surface thereof and the spring terminals 5, 6 are made in contact with the microphone board 3 thereby to electrically couple therebetween.

Figure 4:
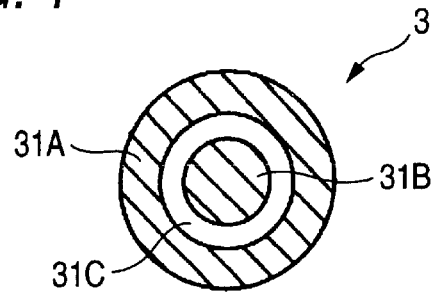
FIG. 4 is an explanatory diagram showing a land constituting a contact point provided at a board on the external side to which the spring terminal of the capacitor microphone according to the invention is coupled.

The microphone board 3 is provided with a contact point 31 (an inner portion side contact point) with which the leg portions of the spring terminals 5, 6 described later are made in contact so as to made conductive therebetween. As shown in FIG. 4, the contact point 31 is configured in a manner that conductive portions 31A, 31B formed by large and small conductive portions arranged concentrically are disposed so as to sandwich an insulation portion 31C formed by a ring-shaped insulation portion therebetween and the leg portions of the spring terminals are made in contact with the conductive portions 31A, 31B.

Figure 5:
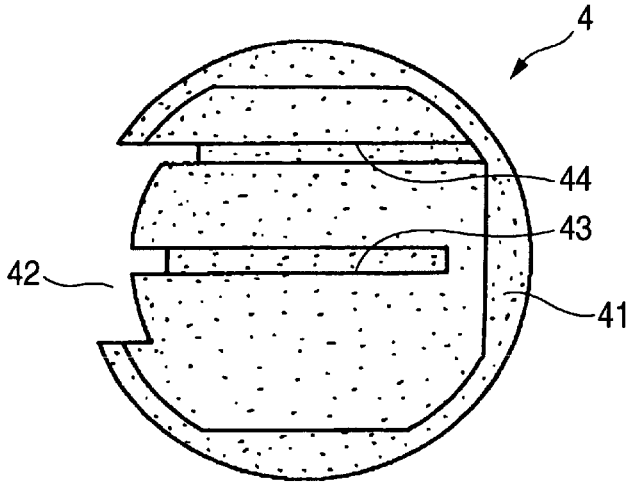
FIG. 5 is a plan view showing an insulator used in the capacitor microphone according to the invention.
Figure 6:
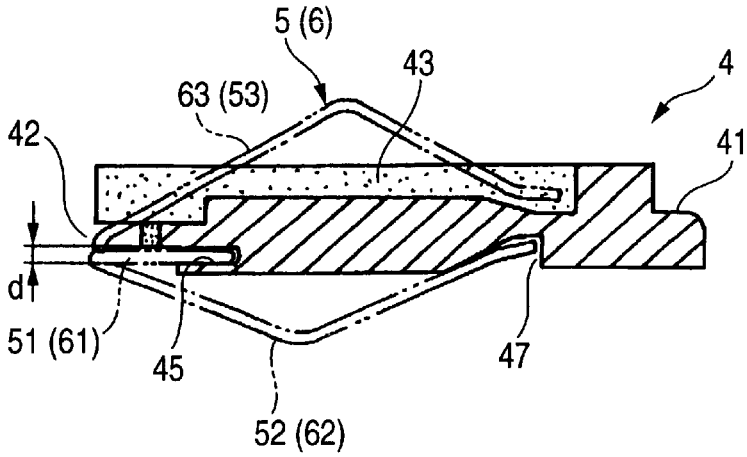
FIG. 6 is a sectional view showing the coupling state of the spring terminal to the insulator according to the invention.
Figure 7:
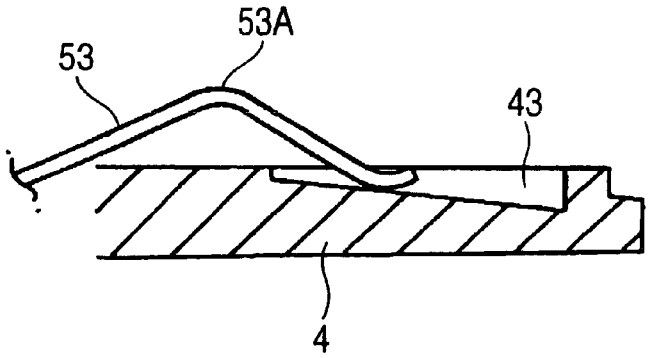
FIG. 7 is a sectional view showing the contact state between the spring terminal and guide groove of the insulator according to the invention.
Figure 10:
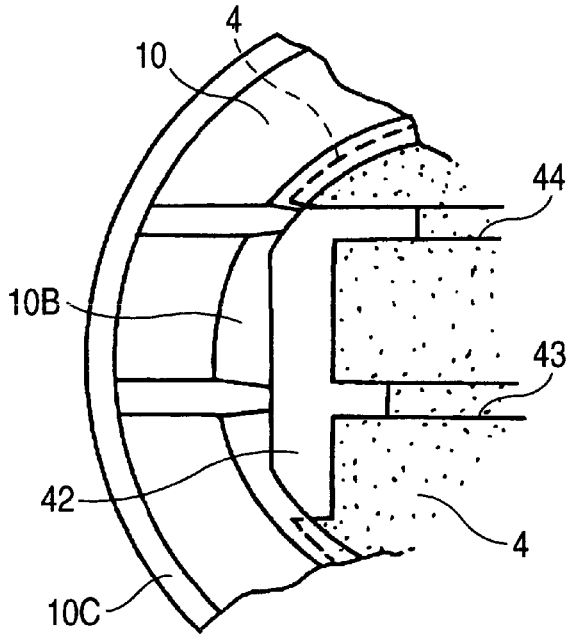
FIG. 10 is an enlarged diagram showing a main portion of the insulator used in the capacitor microphone according to the invention.
Figure 11:
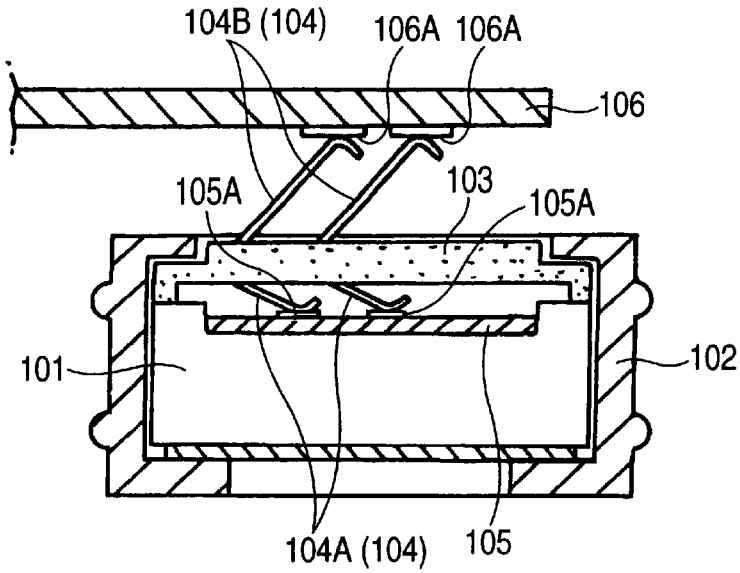
FIG. 11 is a sectional view showing the contact state between the spring terminals of a conventional capacitor microphone and inner and outer contact points.
Figure 12:
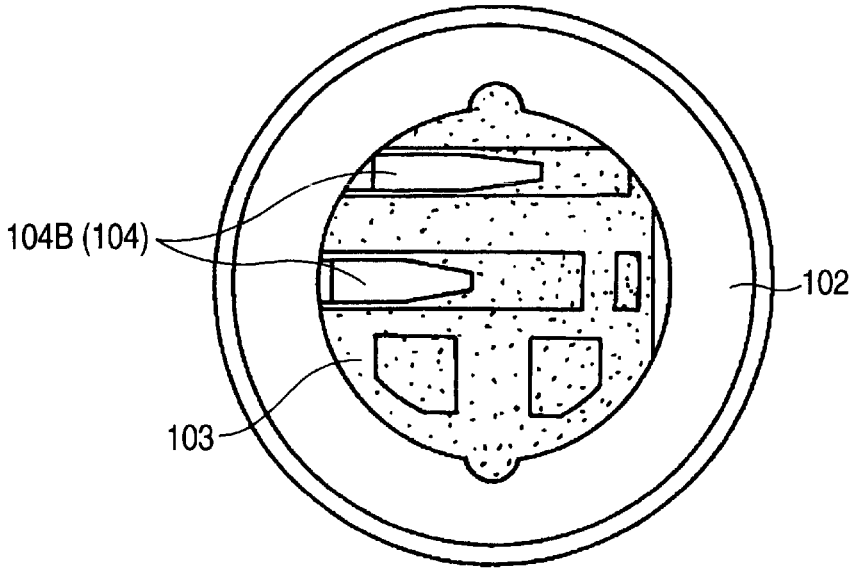
FIG. 12 is a plan view showing a displacement state of spring terminals in the conventional capacitor microphone.

The insulator 4 is disposed on the one surface of the capacitor microphone main body 2 on which the concave portion 2A is provided. As shown in FIGS. 5 and 6, the insulator is formed in an almost disk shape by using suitable insulation material. The insulator 4 is provided at its peripheral portion with a step portion 41 which engages with the engagement portion 10B of the microphone casing 10 and further provided at a part of the peripheral portion thereof with a notched portion 42 in which the spring terminals 5, 6 enter (see FIGS. 5 and 10).

Further, two guide grooves 43, 44 extending straightly in parallel to each other from the notched portion 42 are cut and formed on the one surface (the upper surface in FIG. 6) of the insulator 4. The leg portions 53, 63 (only the leg portion 53 is shown in the figure) of the spring terminals 5, 6 are inserted into the guide grooves 43, 44 (only the guide groove 43 is shown in the figure) in a state of being slidable freely therein.

As shown in FIG. 6, the insulator 4 is provided with insertion holes 45, 46 (only the insertion hole 45 is shown in FIG. 6) for attaching the base portions 51, 61 of the spring terminals 5, 6 at positions facing on the is notched portion 42 (same as the notched portion 43). The insertion hole 45 is formed so as to have such a size almost corresponding to the thickness d (see FIG. 6) of the base portion 51 of the spring terminal 5 along the plane direction perpendicular to the thickness direction of the insulator 4. The insertion hole is arranged to house and hold therein the base portion 51 of the spring terminal 5 in a stable state not causing a swinging operation. The insertion hole 46 has the similar configuration as the insertion hole 45.

Further, as shown in FIG. 6, guide grooves 47, 48 (only the guide groove 47 is shown in the FIG. 6) extending in parallel to each other are formed on the other surface (the lower surface in the figure) of the insulator 4. The leg portions 52, 62 (only the leg portion 52 is shown in the figure) of the spring terminals 5, 6 are inserted into the guide grooves 47, 48 in a state of being slidable freely therein.

Figure 8A:
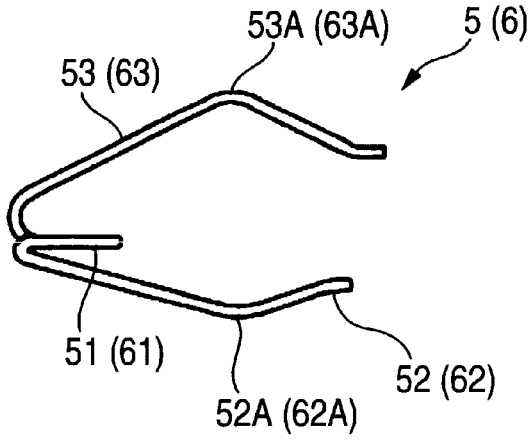
FIGS. 8A and 8B are plan views showing the spring terminal used in the capacitor microphone according to the invention.
Figure 8B:
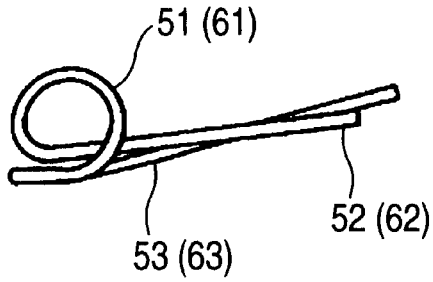

As described above, the spring terminal 5 is intended to be attached to the insulator 4 thereby to electrically connect the capacitor microphone main body 2 with the external portion. As shown in FIGS. 8A and 8B, the spring terminal is provided with the base portion 51 formed by a conductive wire rod and a pair of the leg portions 52, 53 extending from the base portion 51.

The base portion 51 is formed in a ring shape of almost complete round (or may be an angular shape). The spring terminal is fixed and held in the insertion hole 45 of the insulator 4 in a stable state at the base portion thereof.

Figure 9:
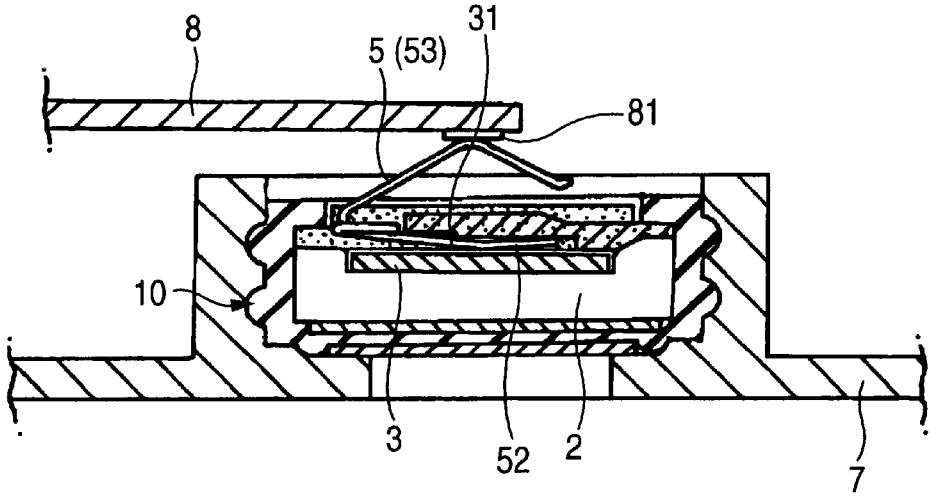
FIG. 9 is a sectional view showing the contact state between the spring terminal of the capacitor microphone according to the invention and inner and outer contact points.

On the other hand, the leg portions 52, 53 are arranged in a manner that they extend in opposite directions so as to be separated and away to each other gradually from the base portions on a plane almost perpendicular to the plane on which the base portion 51 is formed. In other words, the leg portions are each formed in a handle-shape so as to protrude diagonally in the opposite directions from the base portion 51, and each of the leg portions has elasticity. The leg portions 52, 53 are configured in a manner that, as shown in FIGS. 2 and 9, intermediate portions 52A, 53A (see FIG. 8A) constituting summit portions of the respective leg portions are elastically made in contact with the contact point (an external portion side contact point) 81 on the board 8 and the contact point 31 on the microphone board 3 provided within the casing 7 of the portable telephone thereby to make conductive between the intermediate portions and the contact points, respectively.

In particular, the leg portions 52, 53 of the spring 5 are arranged in a manner that, when the intermediate portions 52A, 53A are made in contact with the contact point 31 on the microphone board 3 and the contact point 81 of the board 8, the tip portions of the leg portions 52, 53 apply elastic force to the contact points 31, 81 through the intermediate portions 52A, 53A while being slid on the bottom surfaces of the guide grooves 43, 47, respectively. Accordingly, even if there are error in size, assembling error or deviation in the shapes of the leg portions 52, 53 etc. of the spring terminal 5, the leg portions are configured so as to be able to absorb such error or deviation. Further, in contrast, even if the contact point 31 or 81 applies an excessive contact force to the leg portion 52 or 53 due to the assembling error or deviation of the respective parts, the leg portions 52 and 53 are arranged so as to be able to absorb such an excessive contact force while the tip portions thereof are slid on the bottom surfaces of the guide grooves 43, 47, respectively.

Since the spring terminal 6 is configured in the similar manner as the spring terminal 5, the spring terminal 6 has the similar function as the spring terminal 5. The contact point 81 on the board 8 used in this embodiment has similar configuration as the contact point 31 on the microphone board 3.

Thus, according to the embodiment, for example, even if there arises variation in an elastic force when the intermediate portions 53A, 63A of the leg portions 53, 63 are made in contact with the contact point 81 of the board 8 due to the error in size or the assembling error of the parts, according to such a phenomenon that the tip portions of the leg portions 53, 63 slide and deviate along the bottom surfaces of the guide grooves 43, 44 of the insulator 4, such variation of the elastic force can be absorbed and eliminated. In this respect, the leg portions 52, 62 have the similar function as the leg portions 53, 63.

As described above, according to the invention, each of the spring terminals provided at the capacitor microphone is formed by a pair of elastic wire rods protruding in directions being separated to each other toward the outside. In other words, each of the spring terminals is formed by wire rods not requiring molds or dies. Thus, the spring terminals can be manufactured without requiring molds or dies with a high accuracy and also manufactured at a low cost in a short time. Accordingly, the capacitor microphones can be manufactured efficiently at a low cost.

Further, according to the invention, each of the spring terminals is arranged to protrude in directions being separated to each other toward the outside due to the elasticity thereof, so that variation at the time of manufacturing and assembling can be absorbed by the elastic deformation of the spring terminals. Thus, the spring terminals can be made in contact with the contact points of is the board to be connected in a surely stable state. As a result, electrical coupling between the spring terminals and the contact points can be surely realized, and hence the capacitor microphone with high reliability can be realized.

Further, according to the spring terminals of the invention, a portable telephone with high reliability containing a capacitor microphone having such spring terminals can be realized.

What is claimed is:

1. A capacitor microphone comprising:

an insulator fixed to a main body of the capacitor microphone; and a spring terminal having leg portions attached to the insulator so as to conduct an output signal from the capacitor microphone main body to contact points of boards to which the spring terminal is to be coupled;

wherein the spring terminal is formed by a pair of wire rods having elasticity which protrude in directions separating to each other toward outside.

2. The capacitor microphone according to claim 1, wherein the insulator is provided with guide grooves for housing tip portions of the leg portions of the spring terminal in a slidable state, respectively.

3. The capacitor microphone according to claim 1, wherein the spring terminal has a base portion for fixing the leg portions in a state that the leg portions protrude in opposite directions from the base portion toward outside, and wherein the base portion is almost complete round or angular shape.

4. The capacitor microphone according to claim 2, wherein the spring terminal has a base portion for fixing the leg portions in a state that the leg portions protrude in opposite directions from the base portion toward outside, and wherein the base portion is almost complete round or angular shape.

5. The capacitor microphone according to claim 1, wherein each of the leg portions of the spring terminal is formed in a handle-shape extending integrally from the base portion and the tip end portions of the leg portions abut against bottom surfaces of the guide grooves of the insulator.

6. The capacitor microphone according to claim 2, wherein each of the leg portions of the spring terminal is formed in a handle-shape extending integrally from the base portion and the tip end portions of the leg portions abut against bottom surfaces of the guide grooves of the insulator.

7. The capacitor microphone according to claim 1, wherein the spring terminal is arranged in a manner that intermediate portions of the leg portions are made conductive with the contact points while the tip end portions of the leg portions abut against the bottom surfaces of the guide grooves of the insulator.

8. The capacitor microphone according to claim 2, wherein the spring terminal is arranged in a manner that intermediate portions of the leg portions are made conductive with the contact points while the tip end portions of the leg portions abut against the bottom surfaces of the guide grooves of the insulator.

9. A portable telephone comprising:

a capacitor microphone; and a board coupled to the capacitor microphone;

wherein the capacitor microphone includes:

an insulator fixed to a main body of the capacitor microphone; and a spring terminal having leg portions attached to the insulator so as to conduct an output signal from the capacitor microphone main body to contact points of boards to which the spring terminal is to be coupled;

wherein the spring terminal is formed by a pair of wire rods having elasticity which protrude in directions separating to each other toward outside.

10. A portable telephone comprising:

a capacitor microphone; and a board coupled to the capacitor microphone;

wherein the capacitor microphone includes:

an insulator fixed to a main body of the capacitor microphone; and a spring terminal having leg portions attached to the insulator so as to conduct an output signal from the capacitor microphone main body to contact points of boards to which the spring terminal is to be coupled;

wherein the spring terminal is formed by a pair of wire rods having elasticity which protrude in directions separating to each other toward outside, and wherein the insulator is provided with guide grooves for housing tip portions of the leg portions of the spring terminal in a slidable state, respectively.

* * * * *